US005247538A

United States Patent [19]

Stenzel

[11] Patent Number: 5,247,538

[45] Date of Patent: Sep. 21, 1993

[54] MELTING FURNACE WITH MANIPULATOR FOR CLOSING CRUCIBLES VACUUM-TIGHT

[75] Inventor: Otto W. Stenzel, Gruendau, Fed. Rep. of Germany

[73] Assignee: Leybold Aktiengesellschaft, Hanau, Fed. Rep. of Germany

[21] Appl. No.: 775,222

[22] Filed: Oct. 11, 1991

[30] Foreign Application Priority Data

Aug. 8, 1991 [DE] Fed. Rep. of Germany ..... 4126223

[51] Int. Cl.[5] ..... F27B 14/04; F27B 14/12

[52] U.S. Cl. ..... 373/77; 373/78; 432/262; 432/156; 266/207

[58] Field of Search ..... 373/77, 78, 72; 432/250, 262, 156–157; 266/208, 207, 209–211, 275; 219/420, 421

[56] References Cited

U.S. PATENT DOCUMENTS

| | | | |
|---|---|---|---|
| 3,665,084 | 5/1972 | Samietz et al. | 373/68 |
| 3,912,848 | 10/1975 | Randa | 373/68 |
| 4,117,253 | 9/1978 | Wooding | 373/42 |
| 4,137,422 | 1/1979 | Barbashin et al. | 373/71 |
| 4,216,347 | 8/1980 | Holtermann et al. | 373/95 |
| 4,365,944 | 12/1982 | Pajonk et al. | 266/207 |
| 4,389,191 | 6/1983 | Lowe | 432/250 |
| 4,834,346 | 5/1989 | Heyer et al. | 432/250 |

FOREIGN PATENT DOCUMENTS

| | | | |
|---|---|---|---|
| 1169617 | 12/1956 | Fed. Rep. of Germany . | |
| 1147044 | 11/1957 | Fed. Rep. of Germany . | |
| 247975 | 1/1970 | U.S.S.R. | 266/211 |
| 1033832 | 8/1983 | U.S.S.R. | 432/250 |
| 255479 | 4/1927 | United Kingdom | 432/250 |
| 2099121 | 12/1982 | United Kingdom | 432/250 |

OTHER PUBLICATIONS

LH prospectus 35—120.02 of Feb. 3, 1990, Fig. "Vacuum Arc Skull Melter Model L 500 SM", Part No. 12.

*Primary Examiner*—Bruce A. Reynolds
*Assistant Examiner*—John A. Jeffery
*Attorney, Agent, or Firm*—Felfe & Lynch

[57] ABSTRACT

Apparatus for melting preferably highly reactive metals, such as titanium for example, in a vacuum melting furnace, for example a vacuum arc furnace for the remelting of metals, with one or more melting positions, a melting crucible (5, 28) being provided at each melting position, these crucibles being closed vacuum-tight after the end of the melting operation and then separated from the melting furnace, the furnace being provided with a single manipulator and by this manipulator each single crucible (5, 28) can be closed vacuum-tight by means of a separate crucible closure plate (13, 37).

6 Claims, 8 Drawing Sheets

MELTING FURNACE WITH MANIPULATOR FOR CLOSING CRUCIBLES VACUUM-TIGHT

The invention is an apparatus for melting preferably highly reactive metals, such as titanium, for example, in a vacuum melting furnace, such as a vacuum arc furnace for remelting metals, with one or more melting locations, a melting crucible being provided at each melting location, these crucibles being sealed vacuum-tight after the end of the melting procedure and then being separated from the melting furnace For the melting of highly reactive metals, such as titanium, for example, in the vacuum arc furnace, the melting molds are generally provided with crucible closing valves in order to protect the solidifying ingot after the end of a melt against the access of oxygen. A vacuum arc furnace therefore requires as many crucible closing valves as it has melting locations.

The crucible closing valves are moving components which are loosely placed on the crucible flange before each melt. After the melt the valve is closed and the upper part of the furnace is moved to the next melting location. After the melted or remelted ingot has hardened and fallen below a certain temperature depending on the material, the crucible closing valve is removed and the ingot stripped. (See also in this connection LH prospectus 35-120.02 of Feb. 3, 1990, Fig. "Vacuum Arc Skull Melter Model L 500 SM", Part No. 12).

These known valves have the obvious disadvantage that one crucible closing valve is required for each melting location. Since a vacuum arc furnace usually has two to three melting locations, considerable costs just for the crucible closing valves are involved in a furnace.

It is the object of the invention to replace the two or three valves with an apparatus by which all melting locations of the vacuum arc furnace can be closed vacuum-tight, and thus to achieve a reduction of the cost of manufacture.

This object is accomplished according to the invention in that the furnace is provided with a single manipulator, and with this manipulator each individual crucible can be closed vacuum-tight with a separate crucible closing plate.

Additional features and possibilities of embodiment are further described and identified in the subordinate claims.

Figure 1:
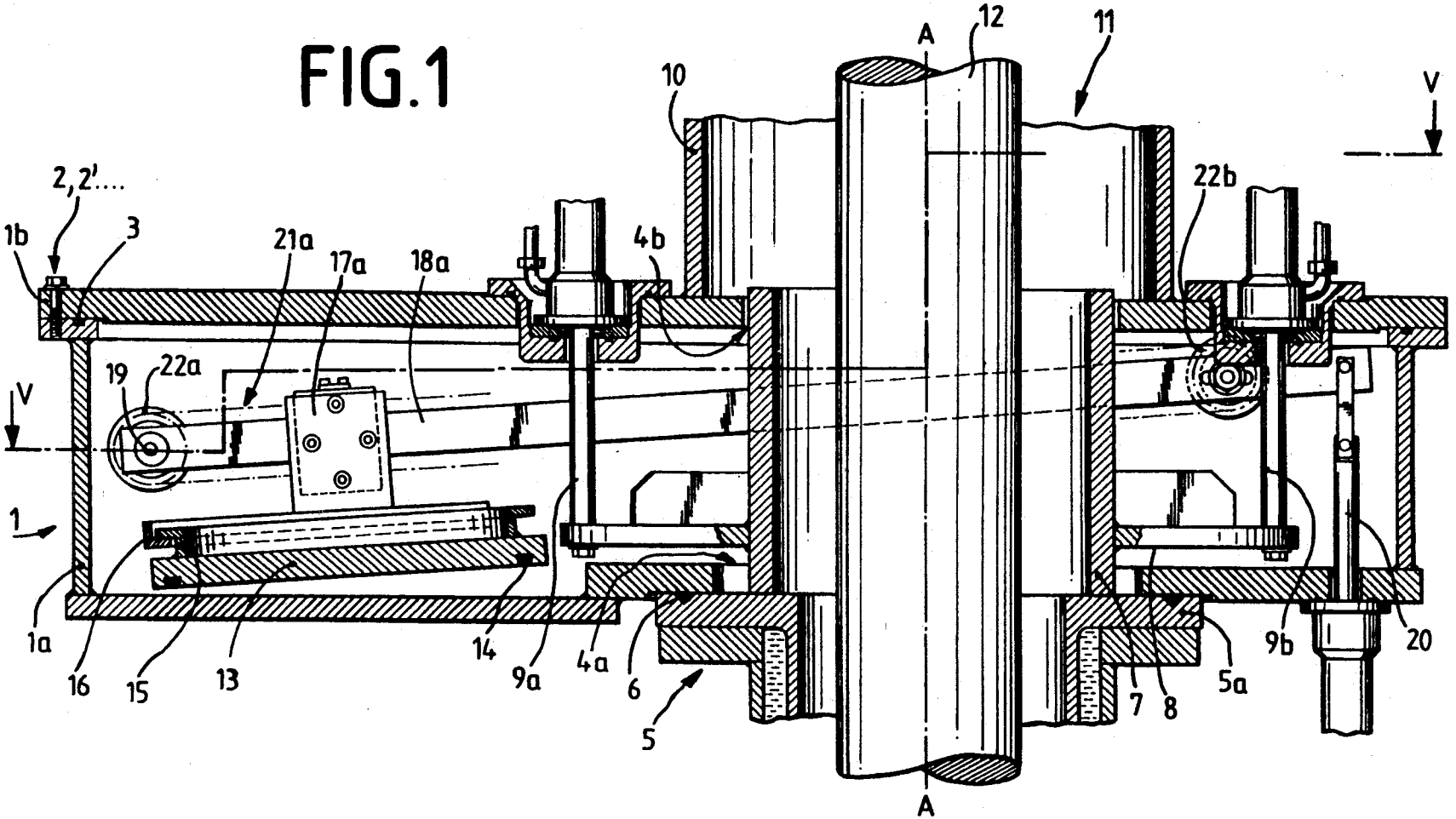
Figure 2:
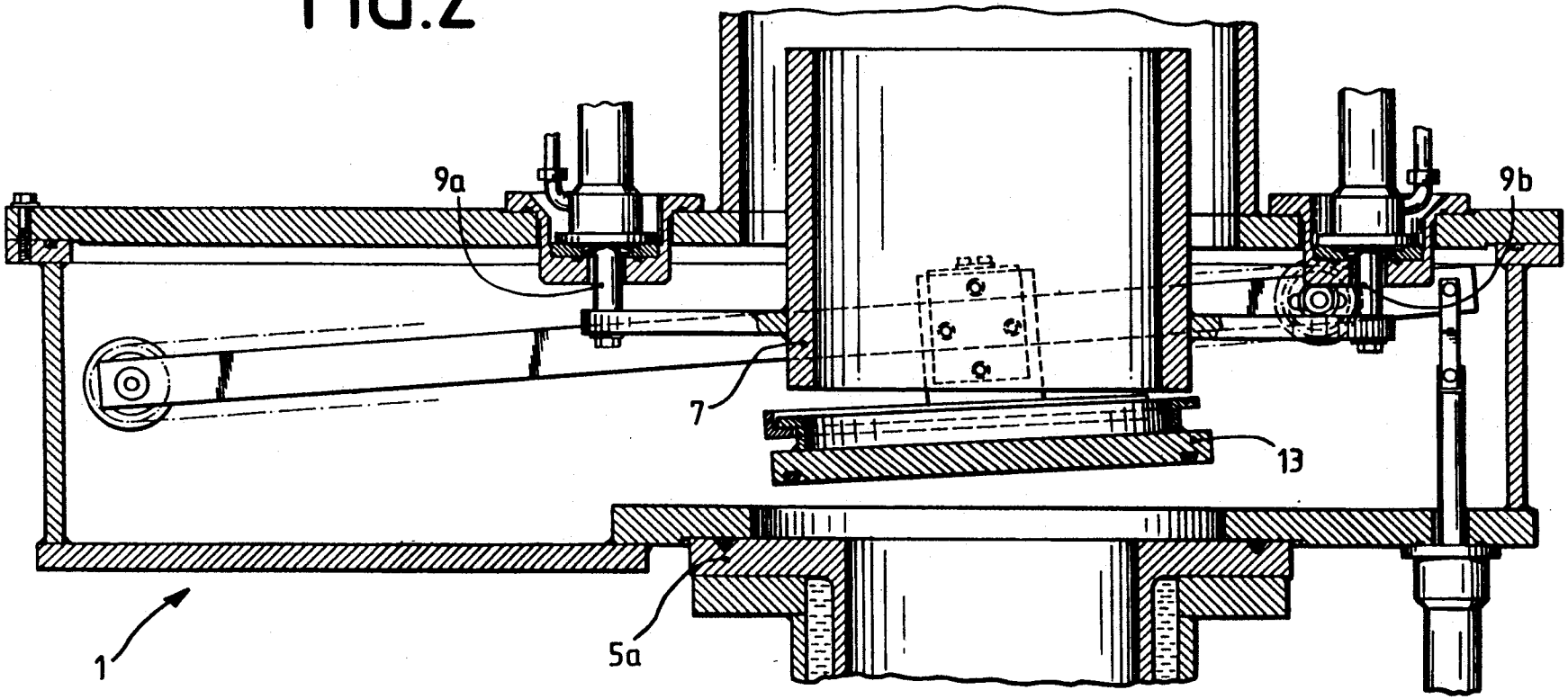
Figure 3:
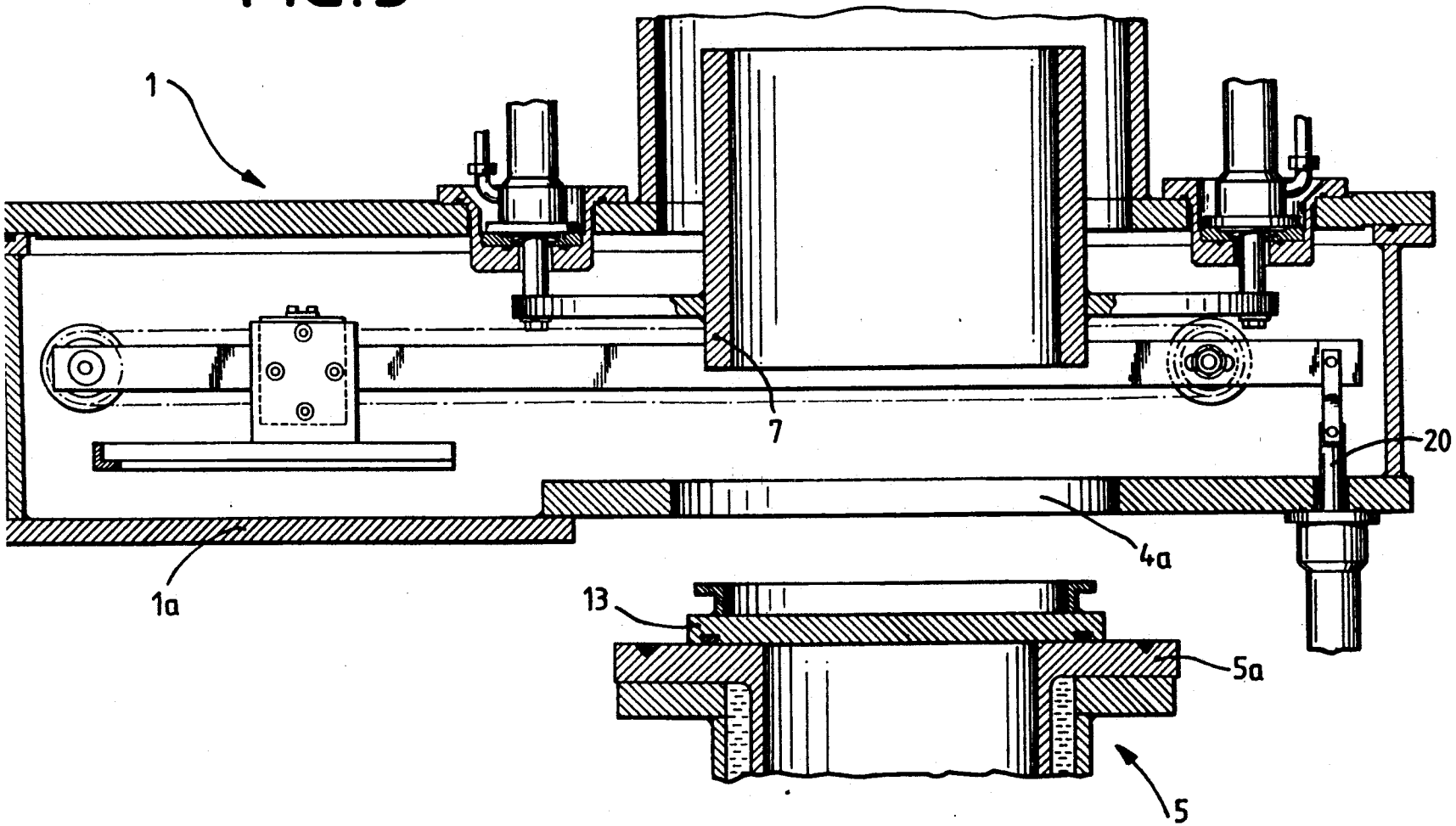
Figure 4:
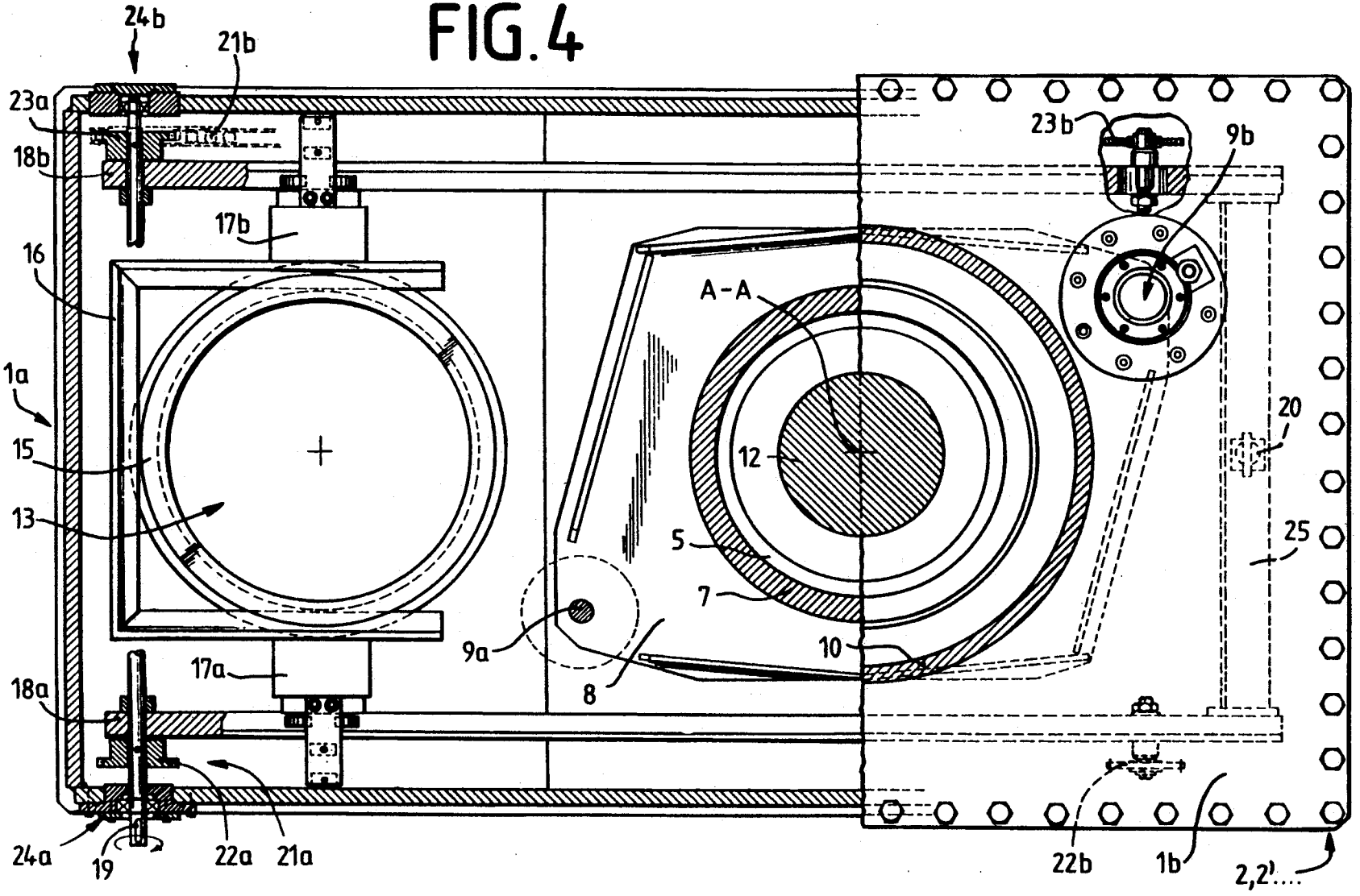
Figure 5:
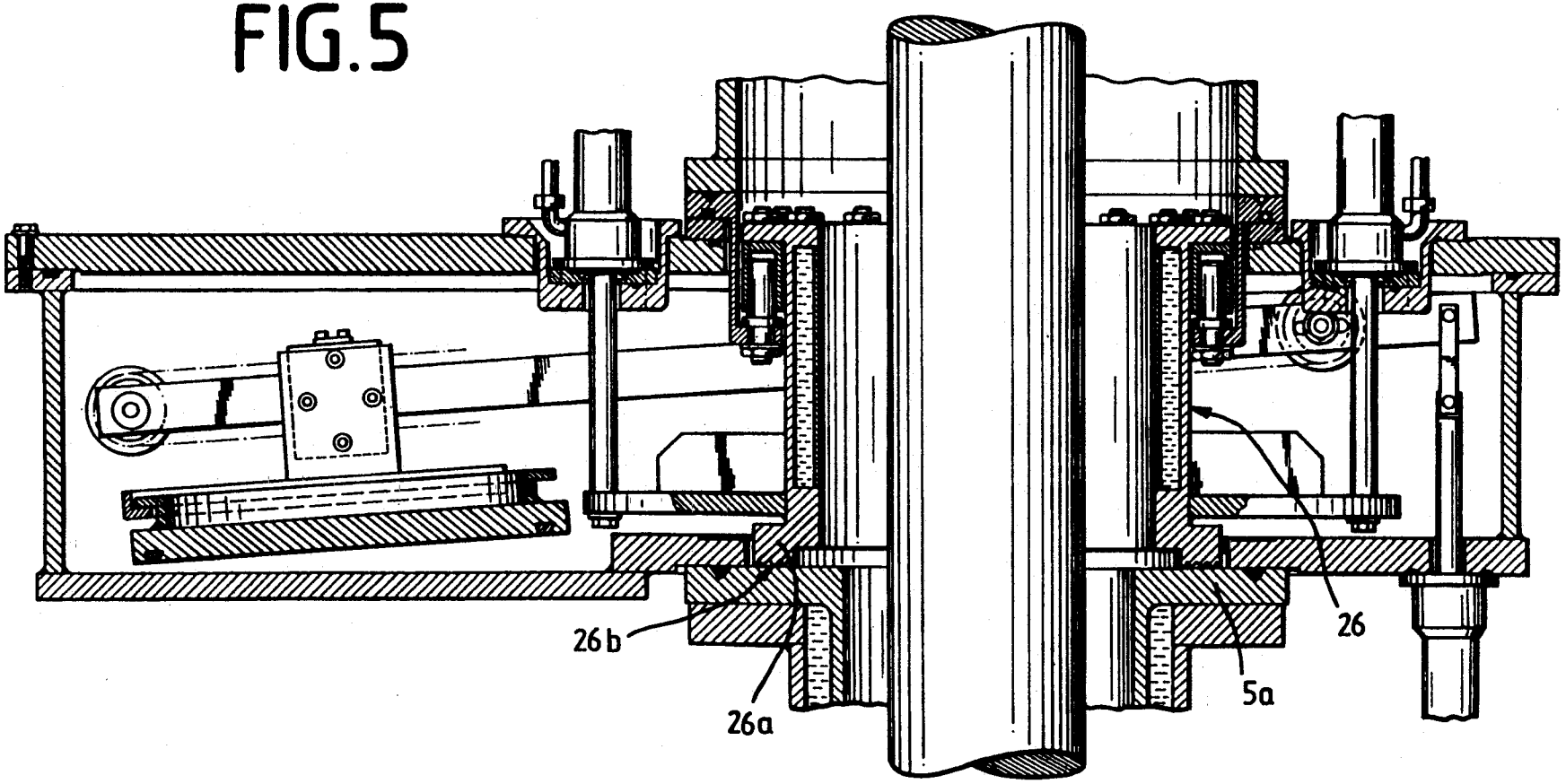
Figure 6:
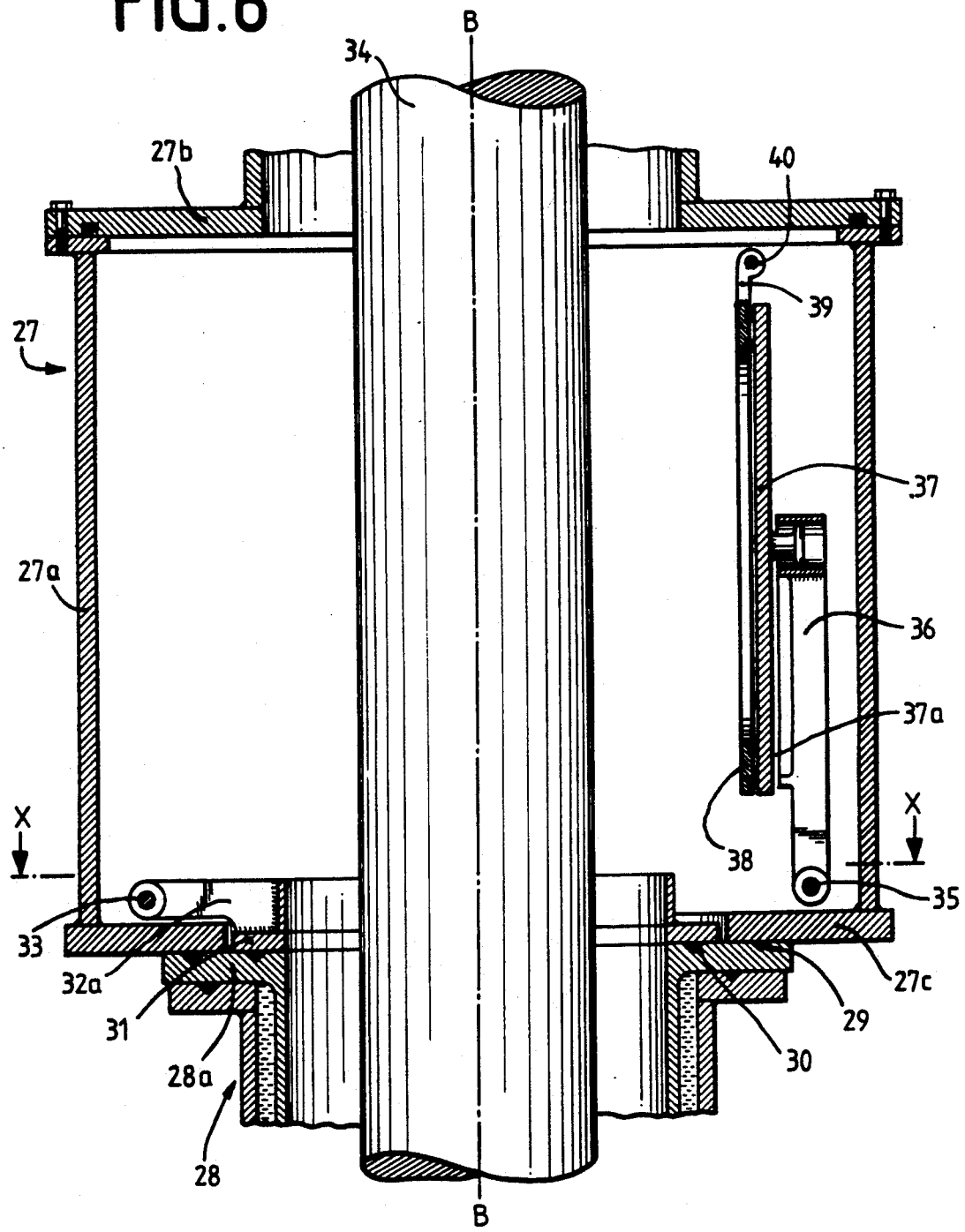
Figure 7:
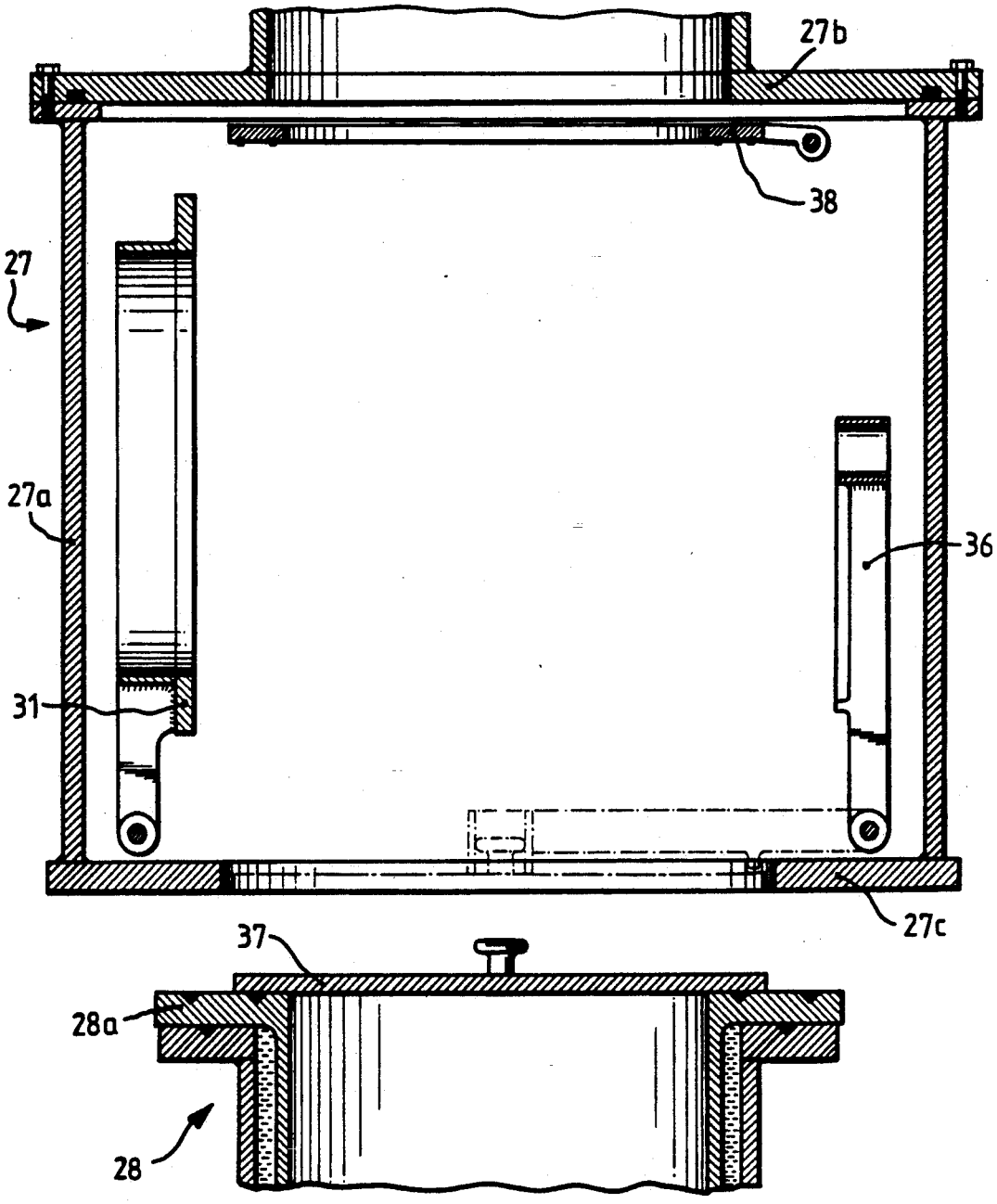
Figure 8:
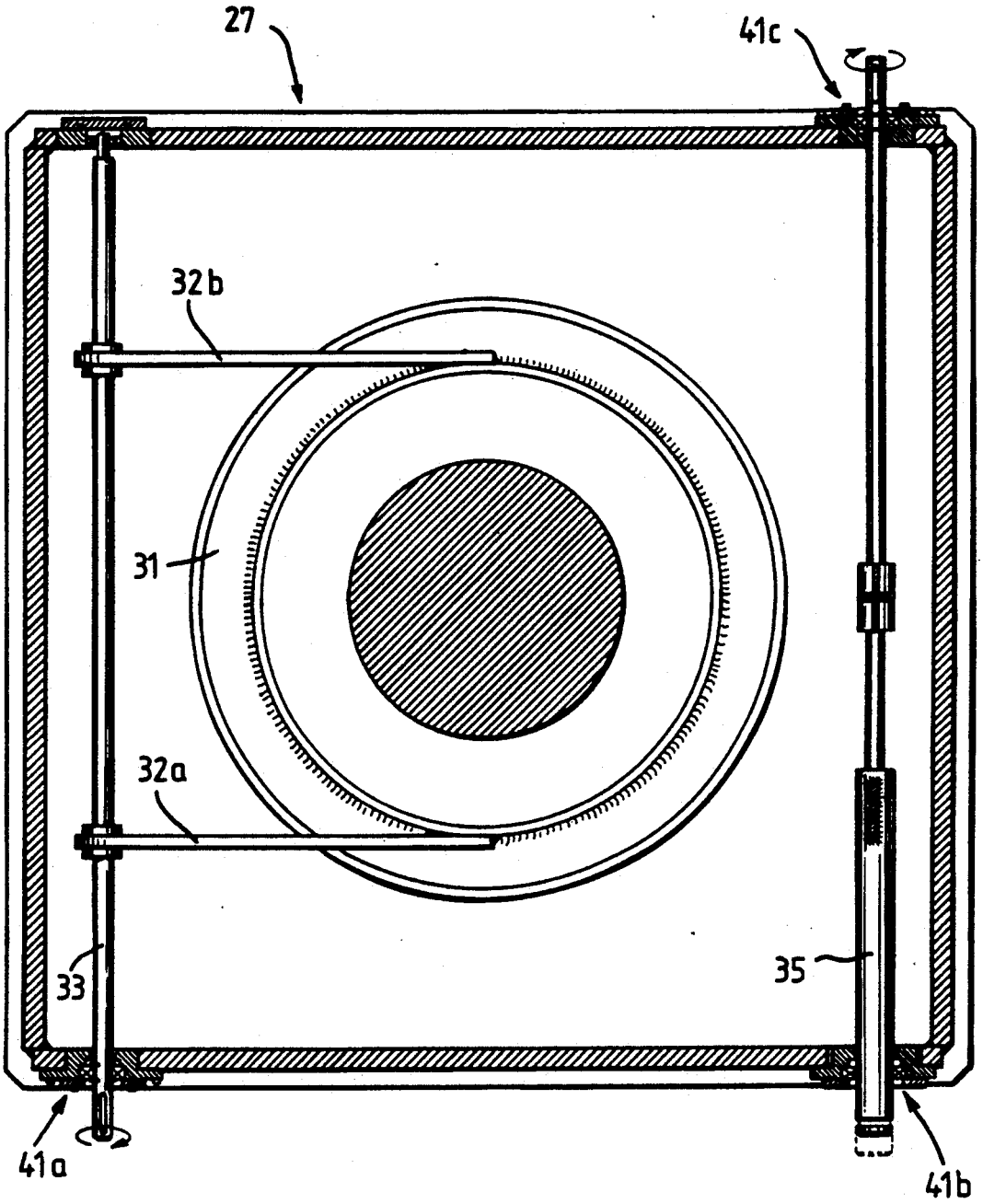

The invention admits of a great variety of embodiments; some of them are represented in the appended drawings, wherein:

FIG. 1 is a cutaway representation of a crucible closing plate manipulator in the slide valve version, in a melting operation, consisting essentially of a slide valve housing, a closing plate, a guard ring, a moving system, and a crucible with electrode rod, FIG. 2 shows in section a manipulator according to FIG. 1, but without electrode, and with the closing plate in midposition, FIG. 3 shows in section a manipulator according to FIG. 1, after the melting procedure, with a closed crucible, as well as a crucible separated from the sliding housing, FIG. 4 shows in plan and in a section along line V—V in FIG. 1, of a manipulator in accordance with FIG. 1, FIG. 5 shows a manipulator according to FIG. 1, but with a guard ring for the transfer of current to the crucible, FIG. 6 shows in section a crucible closing plate manipulator in the flap valve version in a melting operation, consisting essentially of a valve housing, a closing plate, a guard ring, and a crucible with electrode, FIG. 7 is a sectional view of a manipulator according to FIG. 6, but after the melting operation, with a closed crucible, as well as a crucible separate from the valve housing, and FIG. 8 shows a manipulator according to FIG. 6 in a section along line X—X in FIG. 6.

The slide valve housing 1 (FIG. 1) consists of a rectangular, trough-like bottom part la welded vacuum tight, as well as a planar cover lb, which is fastened to the bottom part 1*a* by several screws 2, 2', . . . Between the cover 1*b* and the bottom part la is a vacuum sealing ring 3. Two bores 4*a* and 4*b* are in the bottom part 1*a* and cover 1*b*, concentric with the axis A—A, which is perpendicular to the length of the slide valve housing 1.

Outside of the bottom part 1*a*, a crucible 5 is concentric with the bore 4*a* during the melting operation and by means of a vacuum gasket ring 6 forms a vacuum tight seal with the bottom part 1*a*.

On top of the planar crucible flange 5*a* is a cylindrical guard ring 7 which is of such a length that it reaches just beyond the outside edge of the housing cover 1. The guard ring 7 is inserted concentrically into a flat plate 8 of approximately diamond shape, and welded thereto. Plate 8 is bolted to one end of each of two symmetrically disposed lift rods 9*a* and 9*b* which are mounted by their other ends in the cover 1*b* so as to be displaceable parallel to the axis A—A. On the outer side of cover 1*b* remote from crucible 5 a cylindrical connecting tube 10 disposed concentrically with the axis A—A and joined vacuum-tight to the cover 1*b*. In this manner a cylindrical opening 11 is formed which passes through the slide valve housing 1 concentric with the axis A—A and diminishes step wise in diameter. In this opening 11 an electrode 12 is located coaxial to the axis A—A, and is of such dimensions that its outside diameter is smaller than the minimum inside diameter of opening 11 (namely that of the crucible 5).

In the slide valve housing 1, beside the component assembly for operating the guard ring 7, which is disposed concentrically about the axis A—A, there is also a circular disk-shaped, flat crucible closing plate 13 with the corresponding system for its movement. The plate 13 is provided on its bottom with a vacuum sealing ring 14, and on the upper side there is placed a collar-like ring 15 which is engaged by a U-shaped carrying frame 16.

The frame 16 is held by two carriers 17*a*, 17*b*, which run on the rails 18*a*, 18*b* mounted parallel to one another (see also FIG. 4). These rails 18*a*, 118*b*, extend in the lengthwise direction of the slide valve housing 1 and are mounted at their one end for pivoting about the shaft 19. On the other end of the rails 18*a*, 118*b*, they are engaged by a jack 20 which is brought through the bottom part la of the housing and is disposed parallel to the axis A—A. The carriers 17*a*, 17*b*, can be driven by the circulating chains 21*a*, 21*b* which are driven by and run around the sprocket pairs 22*a*, 22*b*; 23*a*, 23*b*.

FIG. 2 shows essentially the construction of FIG. 1, but immediately after the end of the melting operation. The electrode rod is no longer in the slide valve housing 1, the guard ring 7 is raised to its upper abutting position by the lifting rods 9*a* and 9*b*, and the crucible closing plate 13 is situated in an intermediate position above the crucible flange 5a and approximately concentric with the axis A—A.

After the electrode rod remelting has finished (FIG. 3), first the crucible closing plate 13 is placed by the lifting jack 20 from an intermediate position as indicated in FIG. 2, onto the top of the crucible flange 5a which has been protected up to then by the ring 7. The crucible 5 is thus closed vacuum-tight, and after equalization of the slide valve housing 1, which up to then has been evacuated, the crucible 5 is set down by an apparatus not shown in the direction of the axis A—A, and thus frees the bore 4a in the housing bottom 1a. The slide valve housing 1 can then be turned by means of an additional device not represented, to the next melting station. If a section is taken along the line V—V in FIG. 1, a picture is formed as represented in FIG. 4. In the longitudinal sides of the housing bottom part 1a, the shaft 19 is carried in bearing units 24a, 24b, such that it is parallel to the transverse side of the bottom part 1a, and the one end of the shaft 19 is sealed against the atmospheric pressure prevailing outside of the housing, and the opposite end is brought through the side wall of the bottom part 1a. Furthermore, the sprockets 22a, 23a, are fixedly mounted on the shaft 19, and the two drive chains 21a, 21b run over them and pass around the corresponding sprockets 22b, 23b.

Between the two rails 18a, 118b, the transport frame 16 is held by the carriers 17a, 17b, of the transport frame 16 in which the holding ring 15 of the crucible closing plate 13 is suspended. The electrode rod 12, the crucible 5, the guard ring 7 and the connecting tube 10 can be seen concentrically around the axis A—A. The two lift rods 9a, 9b, and their corresponding drives are situated diametrically to the axis A—A on the two corners of the approximately diamond-shaped holding plate 8 with the greatest distance apart.

For the symmetrical linking of the jack 20 to the two rails 18a, 118b, the latter are joined together by a cross-bar 25 to form a U-shaped frame.

The cover 1b of the slide valve housing is mounted on the bottom part la by the screws 2, 2', . . .

FIG. 5 shows a manipulator during a melting operation; it is similar to FIG. 1, but with a guard ring 26 appropriate for the transfer of current. This ring differs essentially from the ring 7 shown in FIG. 1 by being double walled for the liquid cooling of the ring 26 and a flange-like portion 26a with a contact surface 26b for the transfer of current to the crucible flange 5a.

An alternative to the manipulator in the slide valve version is a flap valve design as shown in FIG. 6.

During a melting operation the valve housing 27 consisting of a bottom part 27a and a cover 27b is in direct contact with the crucible 28 which is provided on the top of its crucible flange 28a with a vacuum sealing ring 29.

A second sealing ring 30 situated radially further inward is covered by a superimposed guard ring 31, which is pivoted about a horizontal shaft 33 by means of a lever 32a fastened tangentially to the ring 31. An electrode rod 34 can be moved along the axis B—B vertically through the housing 27 into the crucible 28.

Parallel to the shaft 33 there is provided a second shaft 35, both being disposed close to the housing floor 27c. By means of an arm 36 a circular disk-shaped closure plate 37 is held in the vertical position of rest on this shaft, in which its annular sealing surface 37a is on the radially inward side of the plate 37. This sealing surface 37a is protected against damage during the melting operation by a guard ring 38 which is mounted for rotation by an arm 39 about a shaft 40 situated near the cover 27b and parallel to the two shafts 33 and 35.

After the end of the melting operation the electrode rod is removed out of the valve housing 27 (FIG. 7), the closure plate 37 lies on the crucible flange 28a and the crucible 28 is lowered away from the bottom 27c of the valve housing 27. The two guard rings 31 and 38, as well as the arm 36, are all in their position of rest, parallel in each case to the side walls of the bottom part 27a and to the cover 27b of the valve housing 27.

FIG. 8 shows the parallelism of the two shafts 33 and 35, as well as the vacuum rotary pass-throughs 41a, 41b, 41c. The rotation of the shafts 33 and 35 takes place at two opposite lateral walls and outside of the valve housing 27.

The guard ring 31 situated centrally in the valve housing 27 is carried by the two levers 32a, 32b, disposed parallel to one another and perpendicular to the shafts 33 and 35.

I claim:

1. Apparatus for melting highly reactive metals, in a vacuum melting furnace, having a plurality of melting positions, comprising: a melting crucible provided at each melting position, these crucibles being closed vacuum-tight after the end of the melting operation and then being separated from the melting furnace, separate crucible closure plates, and a single manipulator and by this manipulator every crucible being closable vacuum-tight by means of one of said separate crucible closure plates.

2. Apparatus according to claim 1, in which the manipulator has a carrier and a lifting drive and the separate closure plates are actuated via closing members of slide valves.

3. Apparatus according to claim 1, in which the manipulator is constructed via a flap valve having an arm with a closure plate fastened thereto.

4. Apparatus according to claim 2, which includes a separate housing which is integrated into the vacuum melting furnace for the disposition of the manipulator.

5. Apparatus according to claim 1, which includes for each crucible closure plate a crucible flange corresponding thereto having a vacuum sealing surface nd a vacuum sealing ring, the closed state being made by the melting surface and the sealing ring.

6. Apparatus according to claim 5, which includes for the vacuum sealing surfaces a guard ring during the melting operation and this guard ring (7, 31, 38) being movable by means of lifting rods (9a, 9b) from a rest position to a protecting position.

* * * * *